US011952093B2

(12) United States Patent
Jank

(10) Patent No.: US 11,952,093 B2
(45) Date of Patent: Apr. 9, 2024

(54) OUTBOARD MOTOR COOLING WATER INDUCTION SYSTEM

(71) Applicant: Mac Steven Jank, Victoria, TX (US)

(72) Inventor: Mac Steven Jank, Victoria, TX (US)

( * ) Notice: Subject to any disclaimer, the term of this patent is extended or adjusted under 35 U.S.C. 154(b) by 77 days.

(21) Appl. No.: 17/570,449

(22) Filed: Jan. 7, 2022

(65) Prior Publication Data

US 2023/0219673 A1 Jul. 13, 2023

(51) Int. Cl.
*B63H 20/28* (2006.01)
*B63H 20/10* (2006.01)
*F01P 3/20* (2006.01)

(52) U.S. Cl.
CPC ..... *B63H 20/28* (2013.01); *B63H 20/106* (2013.01); *F01P 3/202* (2013.01)

(58) Field of Classification Search
CPC ..... B63H 20/28; B63H 20/106; F01P 3/202
See application file for complete search history.

(56) References Cited

U.S. PATENT DOCUMENTS 9,346,694 B2 * 5/2016 Wett ..... C02F 3/34
2008/0014806 A1 * 1/2008 Ide ..... B63H 20/00 440/83

FOREIGN PATENT DOCUMENTS

WO WO-2023085948 A1 * 5/2023

* cited by examiner

*Primary Examiner* — Syed O Hasan
(74) *Attorney, Agent, or Firm* — J. Wiley Horton

(57) ABSTRACT

An outboard motor cooling induction system. A pickup assembly is attached to a boat's transom proximate the keel. An uptake hose from this pickup assembly carries cooling intake water to one or more inlets on the outboard motor's lower unit. An intake plane is provided on the pickup assembly. This intake plane is preferably positioned so that the intake flow is optimized.

20 Claims, 12 Drawing Sheets

OUTBOARD MOTOR COOLING WATER INDUCTION SYSTEM

CROSS-REFERENCES TO RELATED APPLICATIONS

Not Applicable.

STATEMENT REGARDING FEDERALLY SPONSORED RESEARCH OR DEVELOPMENT

Not Applicable.

Microfiche Appendix

Not Applicable.

BACKGROUND OF THE INVENTION

1. Field of the Invention

This invention relates to the field of boats. More specifically, the invention comprises a system for providing cooling water to an outboard motor that is set to run at a shallow depth.

2. Description of the Related Art

The present invention is not limited to any particular type of vessel or motor. However, it is well suited to vessels adapted for moving in shallow water. The drawing figures illustrate exemplary embodiments applied to this type of vessel.

FIG. 1 depicts a prior art skiff 10. This is a type of vessel configured to perform well in shallow water. Hull 16 has a broad and flat keel. An operator steers the boar from center console 14. Platform 12 provides a height advantage for fishing, spotting, and navigation. Propulsion is provided by outboard motor 18, which is attached to the boat's transom.

FIG. 2 depicts an exemplary prior art outboard motor 18. Transom bracket 38 is configured to be attached to a boat's transom. Numerous holes and slots are provided so that bolts can be passed through the transom bracket and into the transom. Jack plate 22 slides up and down with respect to transom bracket 38. The outboard motor is attached to the jack plate. In some instances the jack plate is integral to the outboard motor itself—though not in the example of FIG. 2. Hydraulic or electrical actuators are typically used to raise and lower jack plate 22—along with the attached outboard motor. Modern jack plates are strong enough to permit motion while the motor is running and even while it is producing full power.

Transom bracket 38 remains in a fixed position with respect to the vessel's transom (following some initial adjustments made during installation). Vertical adjustment of jack plate 22 with respect to transom bracket 38 has the effect of raising and lowering the position of propeller 30 within the water.

Lower unit 28 includes the angled drivetrain providing rotational power to propeller 30. Other features are typically included in the lower unit to direct and control the water flow around the propeller. Anti-ventilation plate 26—sometimes called an "anti-cavitation plate"—provides a planar surface above the propeller that tends to keep the propeller submerged when running at an elevated position. Anti-splash plate 36 lies proximate the top of lower unit 28. Skeg 24 provides some yaw stabilization and also acts to guard the lower arc of the propeller.

Outboard motors are generally liquid-cooled. They do not used a closed circulation system. Instead, an engine-driven pump draws in surrounding water, circulates it through the engine, and then discharges it overboard. Most outboard motors employ cooling water inlets located between the propeller's axis of rotation and anti-ventilation plate 26. In the example shown in FIG. 2, starboard inlet 32 is the water intake for the cooling system on the starboard side of the motor. A corresponding port inlet is found on the opposite side. The location of these inlet ports ultimately limits the height to which an outboard motor can be raised while operating, as will be explained.

FIGS. 3 and 4 provide side elevation views. FIG. 3 shows outboard motor 18 in its lowest position, with jack plate 40 resting down within transom bracket 38. The reader will note that propeller 30 lies well below the lowest extent of keel 42. This position allows propeller 30 to remain submerged at any speed. However, the overall draft of the vessel is increased significantly. Skeg 34 extends well below 34 and can strike submerged objects or become lodged in the mud.

FIG. 4 shows the same configuration after jack plate 40 (and motor 18) have been raised to their highest position. In this configuration, part of propeller 30 actually lies above keel 42. The propeller will remain submerged while the boat is operating as a displacement hull. However, this changes when the hull goes up on plane.

FIG. 5 shows the configuration of FIG. 4 with the boat operating above its planing speed. The following description is given from the frame of reference of the boat: Water surface 44 in this operating environment is not purely horizontal. The water surface is very nearly coplanar with keel 42 as it flows out from under the keel. However, the water surface rises as it flows past the lower unit of the outboard motor. This rise leaves propeller 30 partially in the water. However, the reader will immediately note that starboard inlet 32 is now above water surface 44. The motor's cooling system is thereby deprived of inlet water. The outboard motor cannot operate in this configuration without rapidly overheating.

However, the propeller has enough engagement with the water in this configuration to efficiently drive the boat. This may be somewhat counterintuitive for those not accustomed to shallow-draft running. A propeller that is only partially submerged will cavitate if the boat is moving at slow speed (or is at rest). However, if the boat is moving at high speed, a partially submerged propeller still drives efficiently. The fast-moving water (fast moving from the vantage point of the boat) provides a good impedance match for the propeller blades of a partially submerged propeller and cavitation is minimized.

Thus, the configuration of FIG. 5 works well for propulsion if the boat is maintained above its planing speed. However, the configuration does not allow cooling water to enter the outboard motor. The present invention provides a solution for this and other problems.

BRIEF SUMMARY OF THE INVENTION

The present invention comprises an outboard motor cooling induction system. A pickup assembly is attached to a boat's transom proximate the keel. An uptake hose from this pickup assembly carries cooling intake water to one or more inlets on the outboard motor's lower unit. An intake plane is provided on the pickup assembly. This intake plane is preferably positioned so that the intake flow is optimized.

REFERENCE NUMERALS IN THE DRAWINGS

Figure 1:
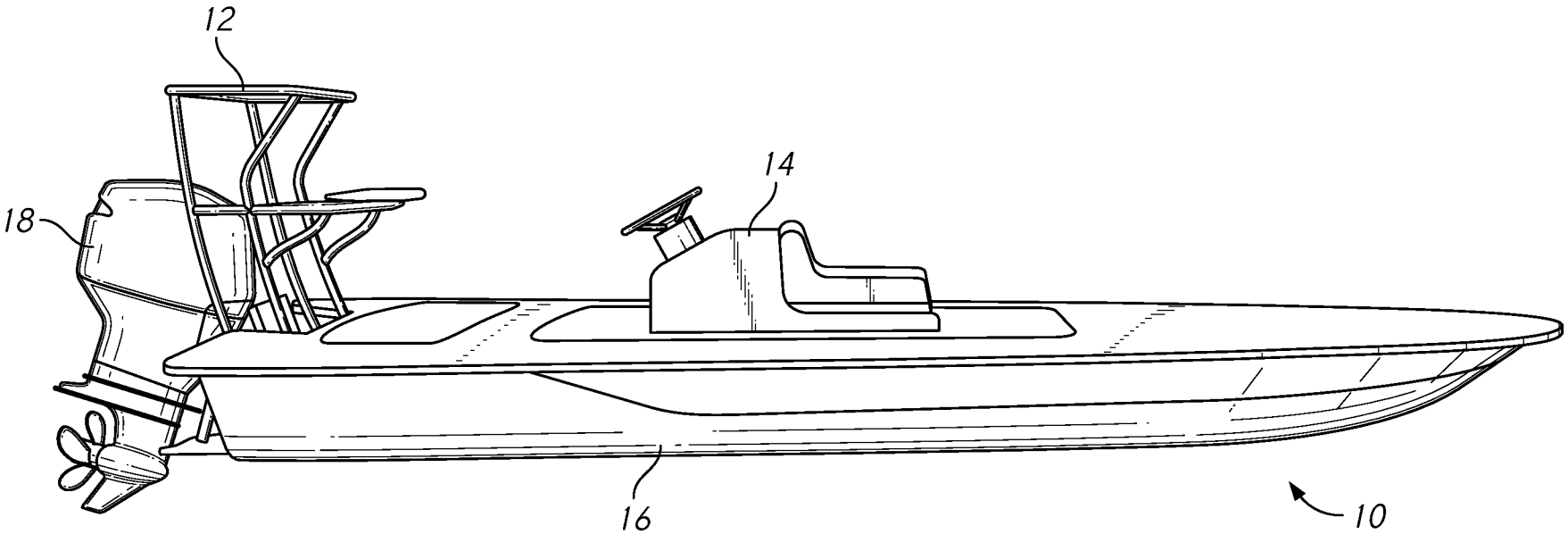
FIG. 1 (Prior Art)
FIG. 1 is a perspective view, showing a prior art skiff configured to run in shallow water.
Figure 2:
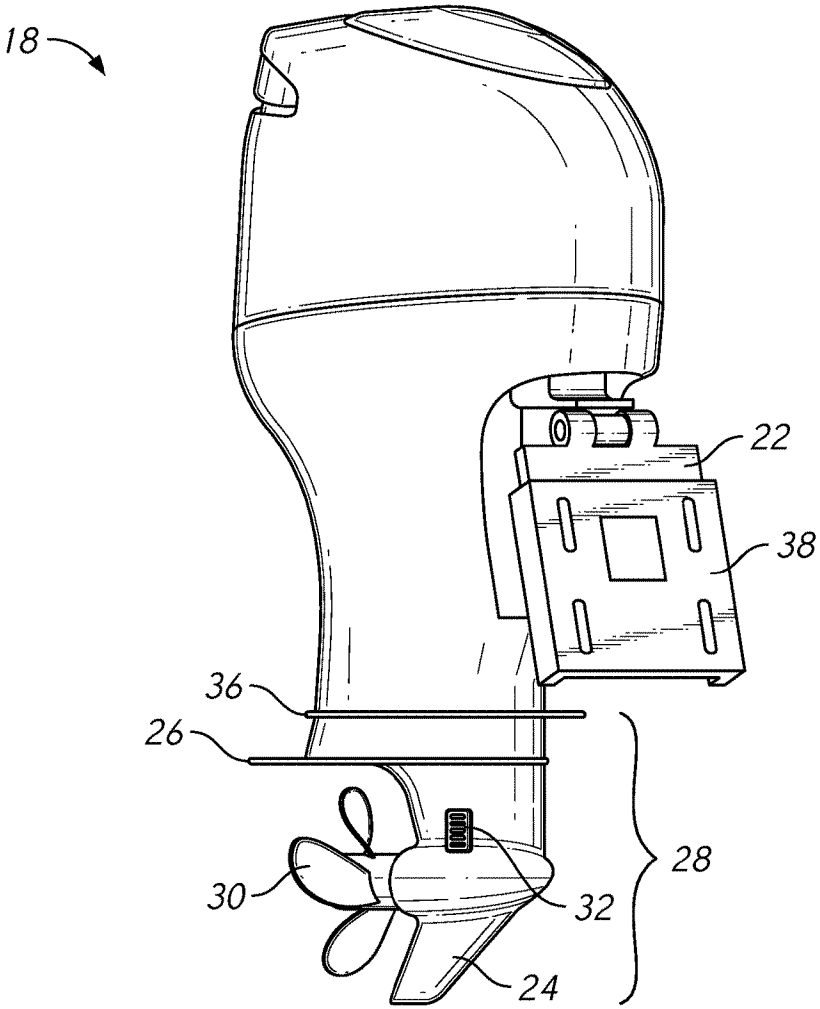
FIG. 2 (Prior Art)
FIG. 2 is a perspective view, showing a prior art outboard motor.
Figure 3:
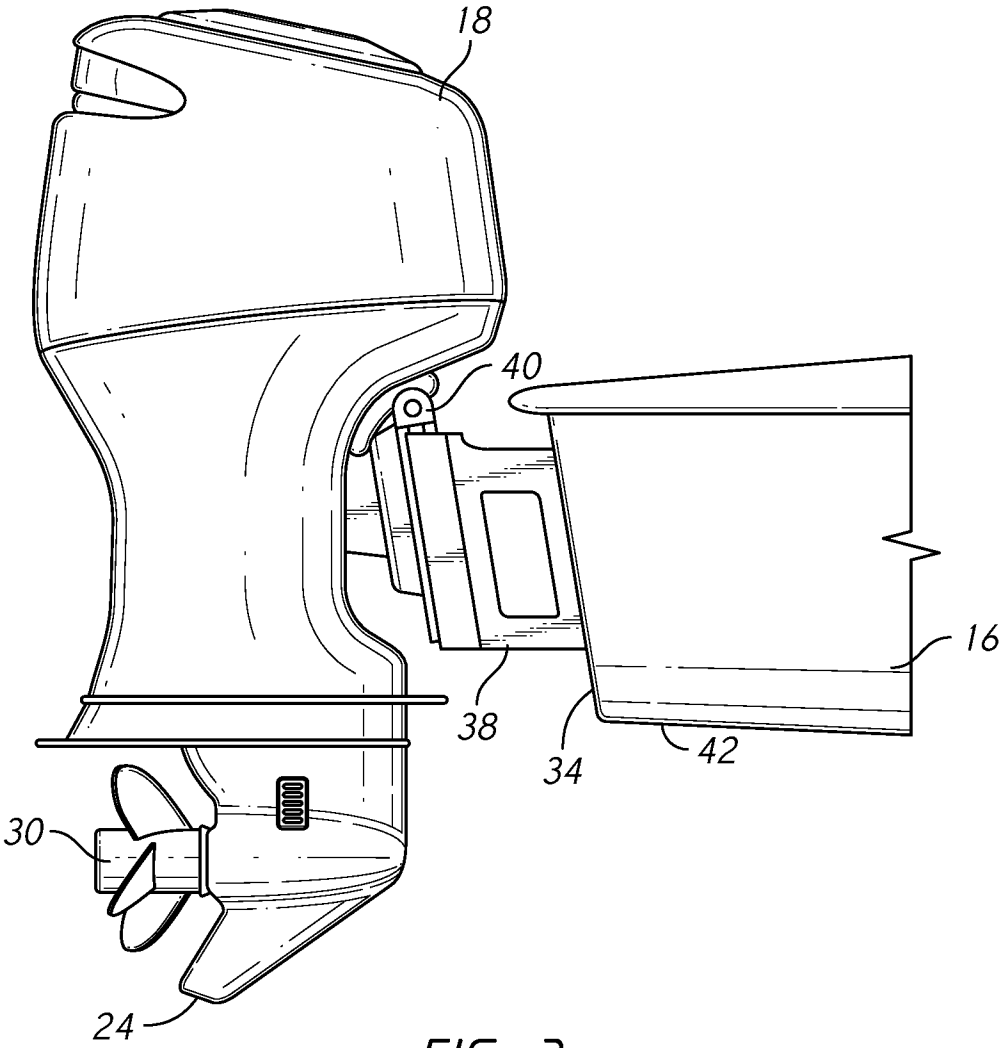
FIG. 3 (Prior Art)
FIG. 3 is a side elevation view, showing how a jack plate is used to adjust the elevation of an outboard motor.
Figure 4:
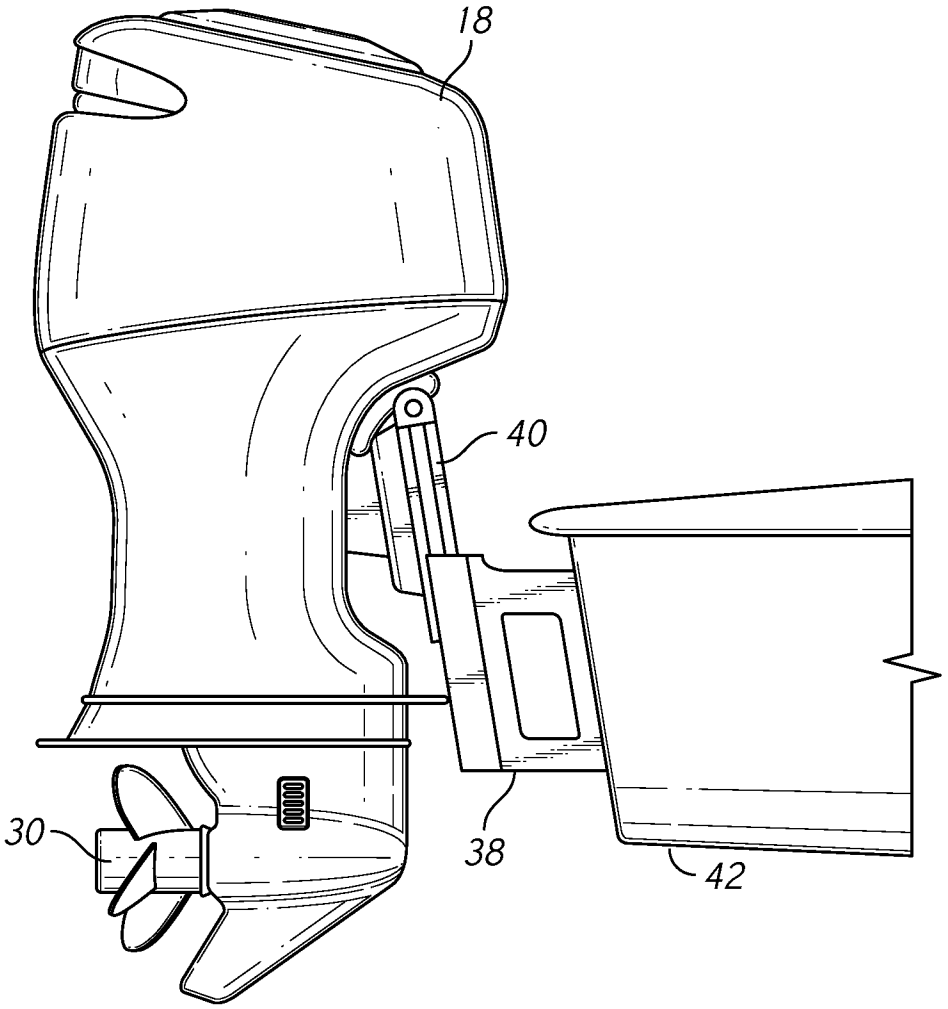
FIG. 4 (Prior Art)
FIG. 4 is a side elevation view, showing how a jack plate is used to adjust the elevation of an outboard motor.
Figure 5:
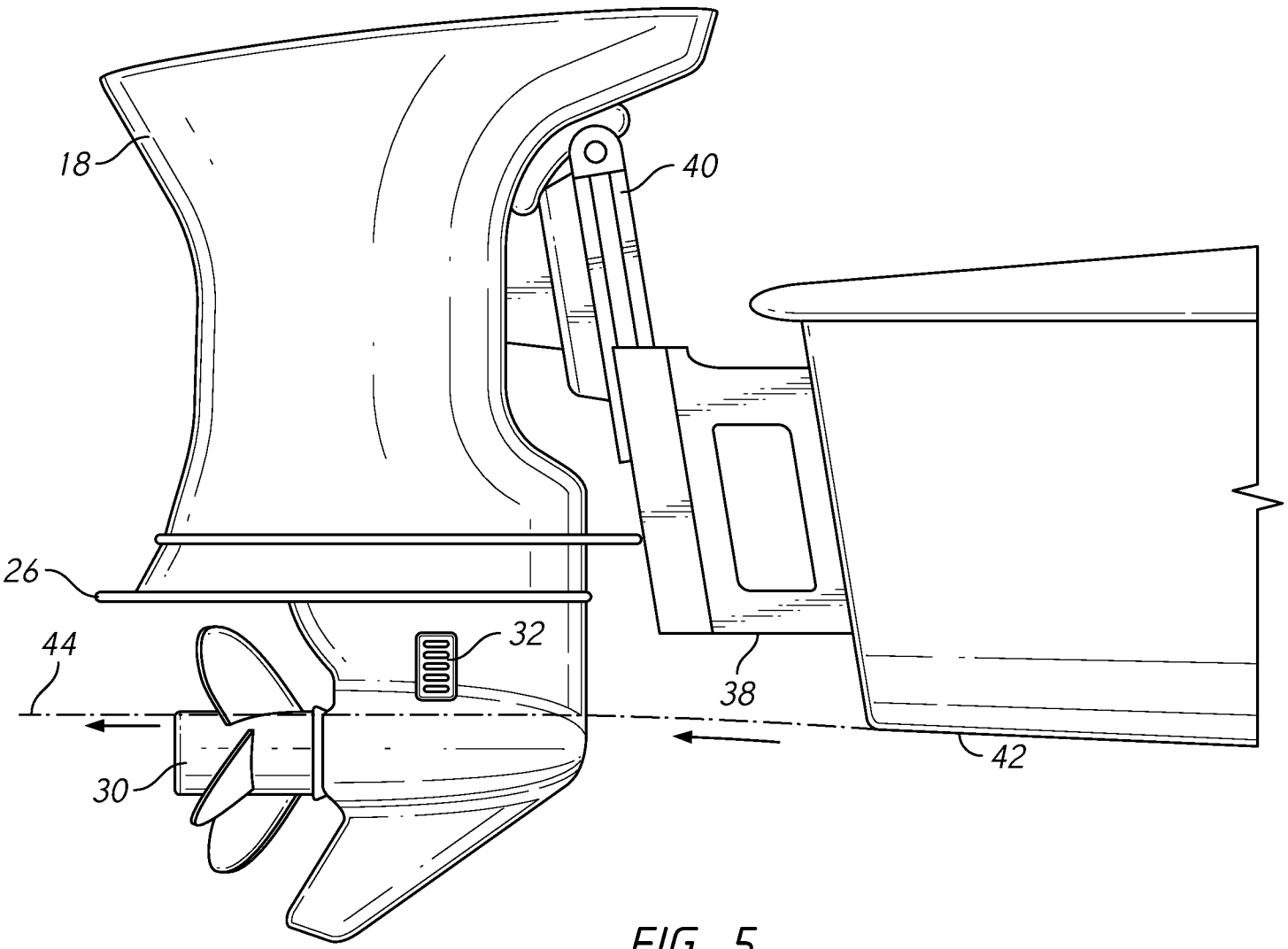
FIG. 5 (Prior Art)
FIG. 5 is a side elevation view, showing how a prior art outboard motor is starved for cooling water when in an elevated position while the boat is moving at high speed.

10 skiff
12 platform
14 center console
16 platform
18 outboard motor
22 jack plate
24 skeg
26 anti-ventilation plate
28 lower unit
30 propeller
32 starboard inlet
34 transom
36 anti-splash plate
38 transom bracket
40 jack plate
42 keel
44 water surface
46 starboard inlet cover
48 pickup assembly
50 uptake hose
52 transverse manifold
54 starboard feed hose
56 starboard inlet
58 port inlet cover
60 port feed hose
62 port inlet
64 filter
66 mounting flange
68 slot
70 body
72 outlet fitting
76 cover plate
77 intake screen
78 fastener
79 intake screen
80 fastener
82 fastener
84 through slot
86 cavity
88 outlet
90 threaded receiver
92 threaded receiver
94 surface
96 screen receiver
98 passage
100 through hole
102 countersink
104 surface
105 intake plane
106 horizontal plane
108 intake angle
110 rib

DETAILED DESCRIPTION OF THE INVENTION

The following descriptions pertain to specific embodiments configured for use with a single type of outboard motor and a single type of boat hull. The invention is by no means limited to these specific applications. Those skilled in the art will be able to easily conceive a much broader set of applications lying within the scope of the present invention.

Figure 6:
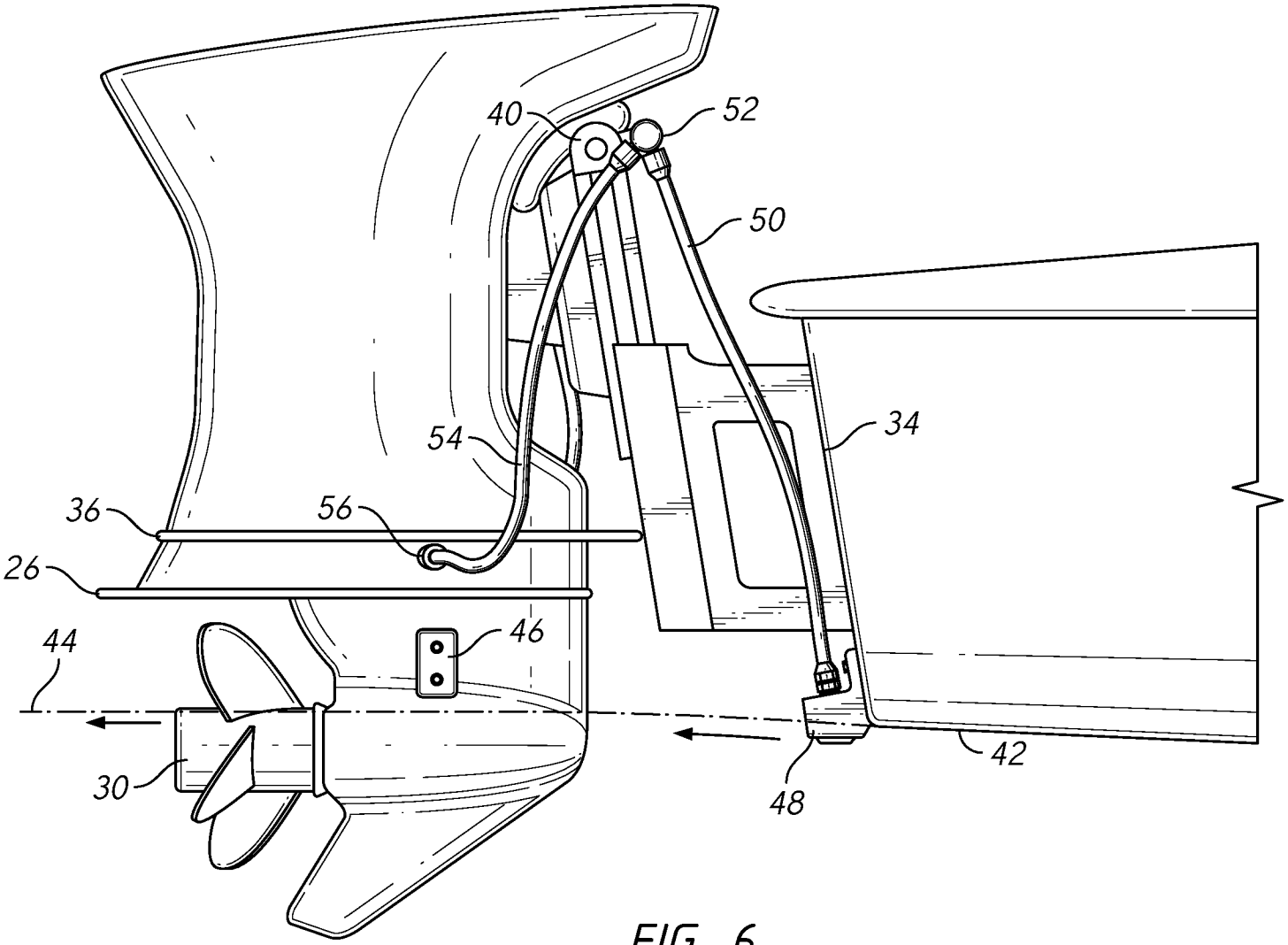
FIG. 6 is a side elevation view, showing a first embodiment of the present invention.

FIG. 6 shows a first inventive embodiment. Starboard inlet cover 46 has been placed over the normal water intakes on the lower unit of the outboard motor. It is important to cover the normal water intakes so that they do not allow the ingress of air when the boat is being operated in the state shown.

The state of operation is above the hull planing speed with the outboard motor in a raised position where some of the propeller arc lies above water surface 44. The figure uses the rapidly moving boat as a point of reference. With this point of reference, the water appears to be rapidly emerging from beneath keel 42 and flowing aft from transom 34—as indicated by the arrows. Water surface 44 is not horizontal. As it emerges from beneath the keel the water surface inclines upward as shown—the result of the passage of the hull through the water.

The reader will note how the conventional water intakes for the outboard motor lie well above water surface 44. The present invention provides an alternate path for cooling water to reach the outboard motor. Pickup assembly 48 in this example is bolted to transom 34 proximate the intersection of transom 34 and keel 42. The pickup assembly includes one or more openings that admit water into its interior. Uptake hose 50 carries water collected by the pickup assembly.

In the example shown, uptake hose 50 connects to transverse manifold 52. This transverse manifold—which may be a hollow tube or even simply another piece of hose—carries water across the front of the outboard motor so that some portion of the water can be fed to the far side of the motor. Starboard feed hose 54 carries water from transverse manifold 52 to starboard inlet 56 in the outboard motor.

Those skilled in the art will know that the interior of the outboard motor's lower unit includes a large hollow passage that is used to carry cooling water up to the cylinder block. The conventional inlets 32 connect this hollow passage to the exterior of the lower unit. It is preferable to add an auxiliary cooling water inlet (starboard inlet 56) to the outboard motor. One way to add such an inlet is to drill a hole through the side of the lower unit between the anti-ventilation plate 26 and the anti-splash plate 36. The hole can be threaded, and an auxiliary cooling water fitting can then be screwed into the threaded hole. Starboard feed hose 54 then connects to this auxiliary cooling water fitting in starboard inlet 56. This connection allows cooling water flowing through starboard feed line 54 into the interior of the lower unit, where it is pulled upward to the engine by the action of the engine-driven pump. Of course, it is also possible to provide an auxiliary cooling water fitting at the time the outboard motor is manufactured.

Figure 7:
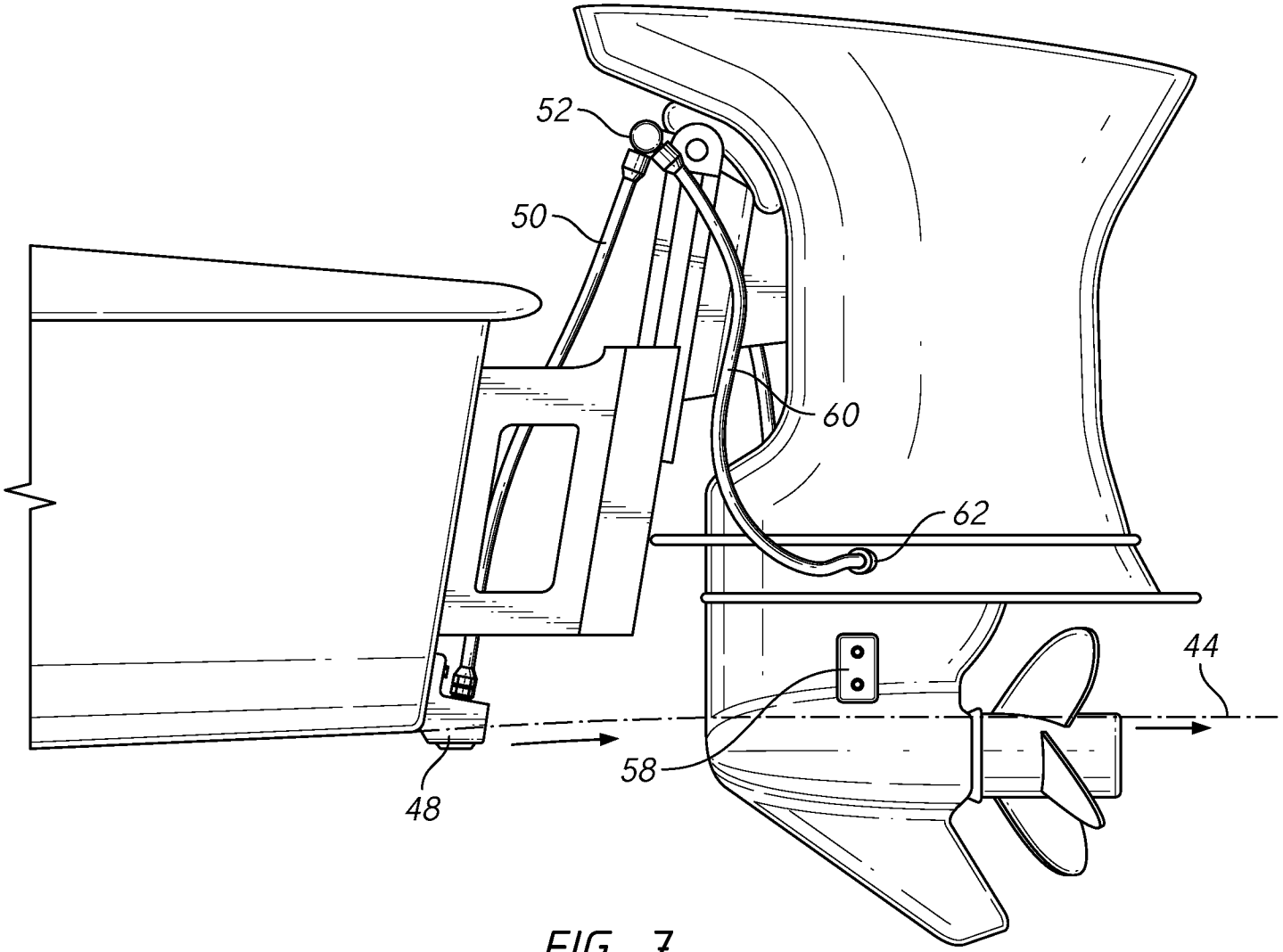
FIG. 7 is a side elevation view, showing the embodiment of FIG. 6 from the opposite side.

In this example, transverse manifold 52 carries water to the opposite side of the outboard motor where a second feed hose is provided. FIG. 7 shows the port side of the outboard. As for the starboard side, a port inlet cover 58 is provided over the conventional cooling water inlets. Port feed hose 60 carries cooling water from transverse manifold 52 to port inlet 62. Port inlet 62 includes a second auxiliary cooling water inlet drilled and tapped into the side of the outboard's lower unit and equipped with an appropriate fitting for joining to the port feed hose.

Figure 8:
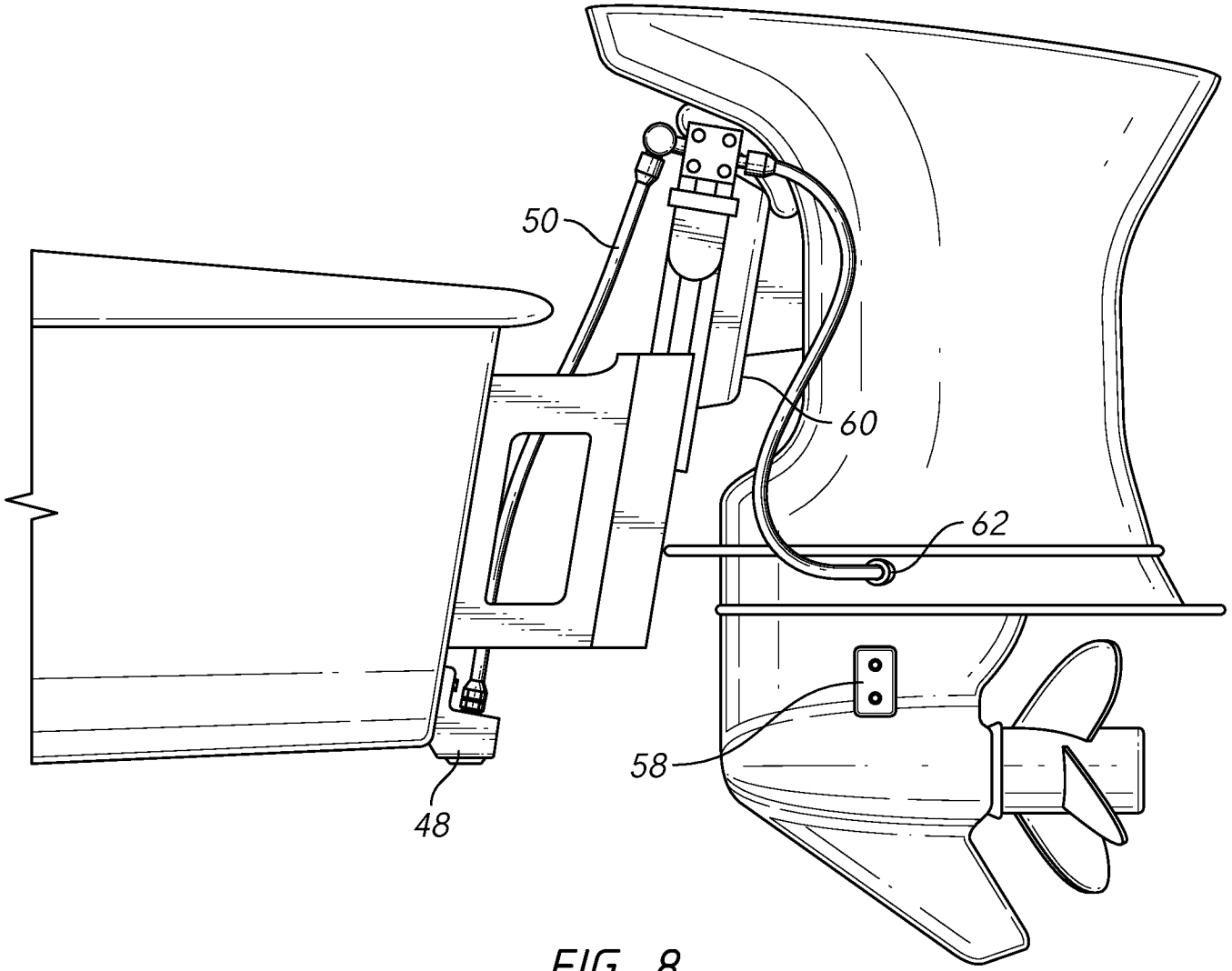
FIG. 8 is a side elevation view, showing a second embodiment of the present invention.

The example of FIGS. 6 and 7 includes a feed hose for each side of the outboard motor. This is not necessary in many applications, as a single feed hose can be sized to carry sufficient cooling water. FIG. 8 shows an embodiment using only a single feed hose. Uptake hose 50 travels from pickup assembly 48 to filter 64. Port feed hose 60 carries water from filter 64 to port inlet 62 on the outboard motor. Provided the pickup assembly, hoses, and inlet are big enough—a single inlet can be sufficient.

The use of a single pickup on one side feeding an inlet on the opposite side provides a somewhat extended flow path. This is actually advantageous in that the extra bends in the hose(s) readily accommodate the raising and lowering of the outboard motor. The filter in this example is preferably one where the filter bowl can be quickly removed, and the filter element can be cleaned manually. Once the element is cleaned, the filter can be put back in place. The use of a filter is not necessary, but it is advantageous when running in muddy or otherwise contaminated water.

Figure 9:
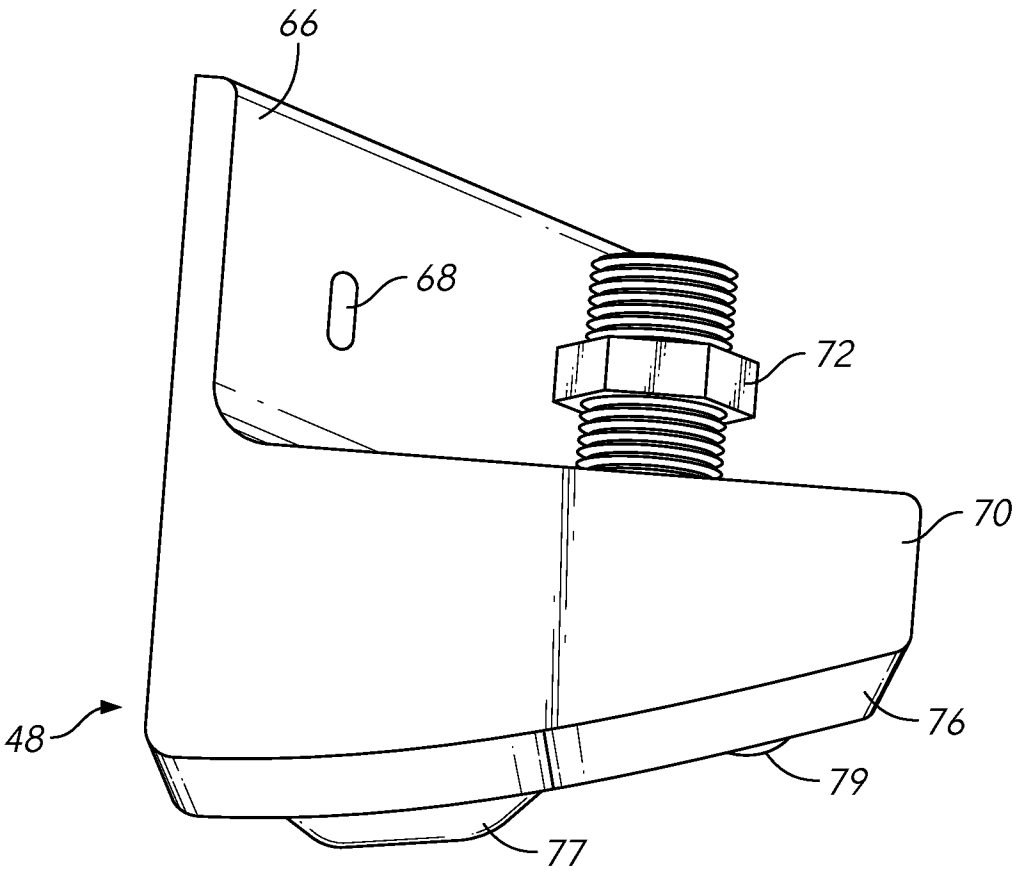
FIG. 9 is a perspective view, showing the inventive pickup assembly in detail.

The nature and positioning of pickup assembly 48 is significant to the present invention. FIGS. 9-12 illustrate features of a specific embodiment of the pickup assembly. FIG. 9 shows a perspective view of pickup assembly 48 taken from the port side. Mounting flange 66 extends upward from body 70. The mounting flange preferably includes two or more slots 68. Fasteners can be passed through these slots to attach the pickup assembly to the boat's transom.

The lower portion of the pickup assembly includes an intake region. In this version intake screens 77, 79 are provided in the intake region. These are located by cover plate 76. Water is taken in through the intake screens into a hollow interior within body 70. Outlet fitting is provided so that the uptake hose can be fluidly connected to the hollow interior of body 70. In this example, outlet fitting 72 includes a threaded portion that is threaded into a hole in body 70. The upper portion of outlet fitting 72 likewise includes a threaded portion. Outlet fitting 72 is preferably an AN-type (Army-Navy, or "military specification" type fitting). The uptake hose includes a suitable threaded end connector that can be screwed onto the exposed male thread of outlet fitting 72. In the case of an AN-type connection, the hose will customarily be fitted with a "B-Nut" compression fitting. While AN-type fittings are a preferred embodiment, the invention is by no means limited to any particular type of fitting.

Figure 10:
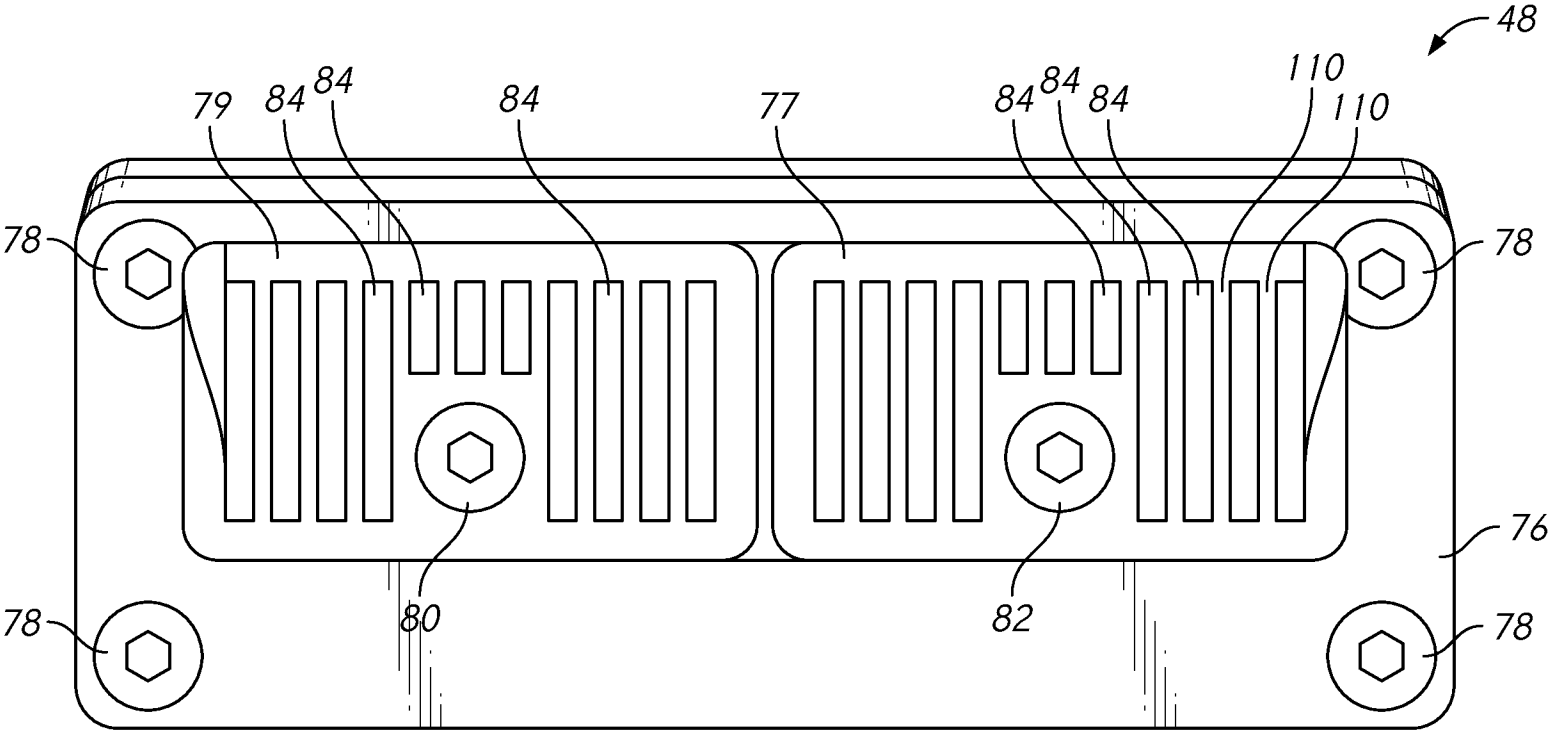
FIG. 10 is a perspective view, showing the intake portions of the pickup assembly in detail.

FIG. 10 provides another perspective view from beneath the pickup assembly. Cover plate 76 is attached to body 70 via four fasteners 78. Intake screens 77, 79 are provided. These are attached to the cover plate and body using fasteners 80, 82. Each intake screen has a plurality of through slots 84 passing into the hollow interior of body 70. Intake cooling water flows in through these slots. The through slots 84 are separated by ribs 110.

The screens serve as a coarse filter for the incoming water. Sticks and other debris cannot be drawn into the interior of body 70. These components are preferably made of durable plastic or metal. Even so, they will tend to wear out over time. In the embodiment shown, the intake screens 77, 79 are designed to be replaceable. The boats typically used with the inventive system are frequently towed out of the water on a trailer. The pickup assembly is easily serviced with the boat out of the water. The user can remove the existing intake screens by removing fasteners 80, 82. The user can then install replacement intake screens.

Two separate intake screens are shown in the version of FIG. 10. In other embodiments a single intake screen will be used. In still other embodiments the through slots 84 will be incorporated directly into cover plate 76.

Figure 11:
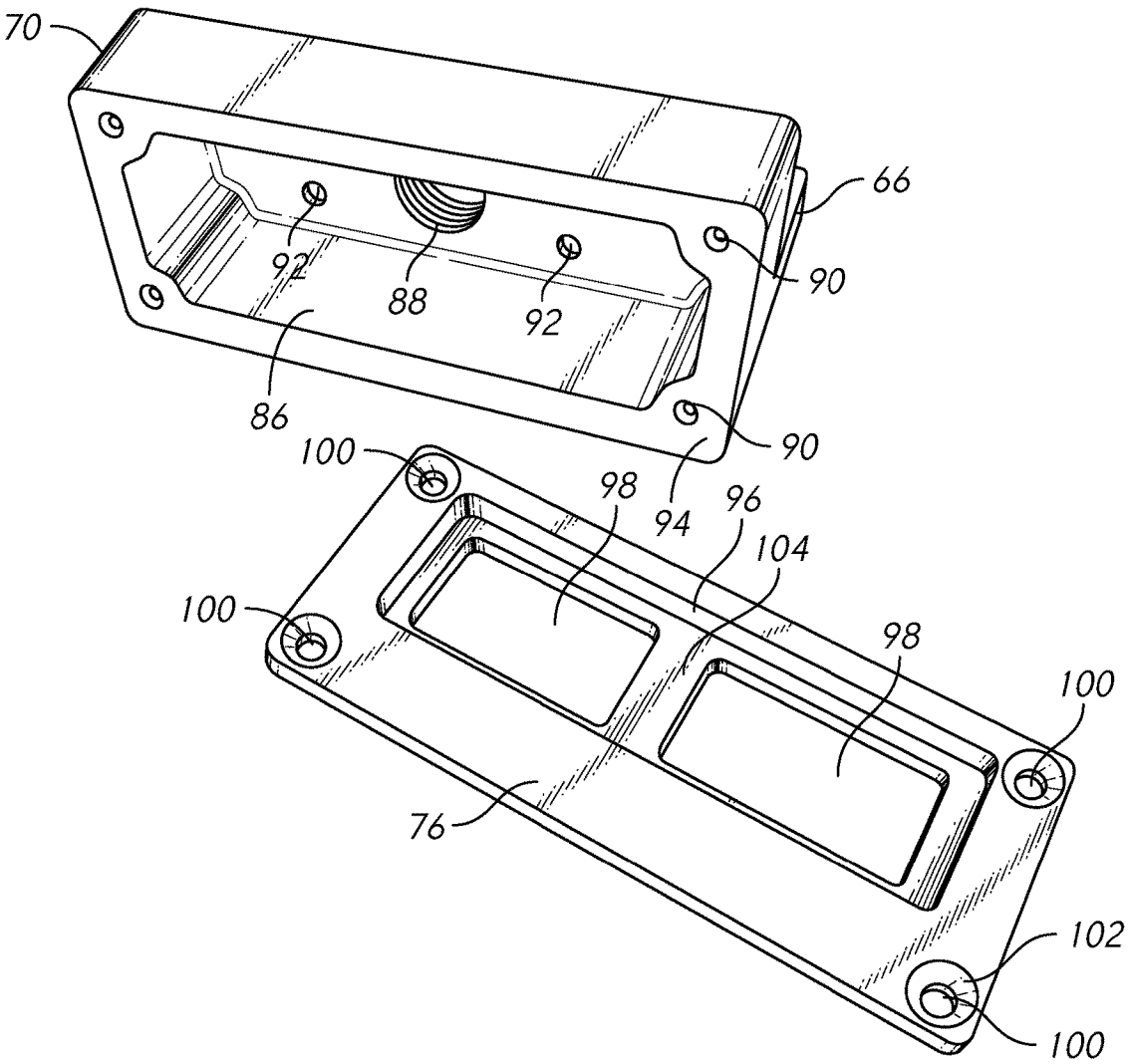
FIG. 11 is a perspective view, showing the pickup assembly in a disassembled state.

FIG. 11 shows body 70 with cover plate 76 removed. In looking at both FIGS. 10 and 11, the reader will appreciate that cover plate 76 is drawn tightly against surface 94 by passing fasteners 78 through holes 100 and into threaded receivers 90. Countersinks 102 are provided so that the heads of fasteners 78 lie flush when installed. The two intake screens 77,79 rest within screen receiver 96 in cover plate 76. Each screen receiver is drawn against surface 104 by passing fasteners 80, 82 through the respective screen receiver and into threaded receivers 92 in body 70.

Passages 98 are provided through cover plate 76. These passages allow water traveling into through slots 84 in the intake screens to flow into the interior of body 70. Outlet 88 is provided in the body. The outlet is given a female thread so that outlet fitting 72 (see FIG. 9) can be screwed into the outlet.

Figure 12:
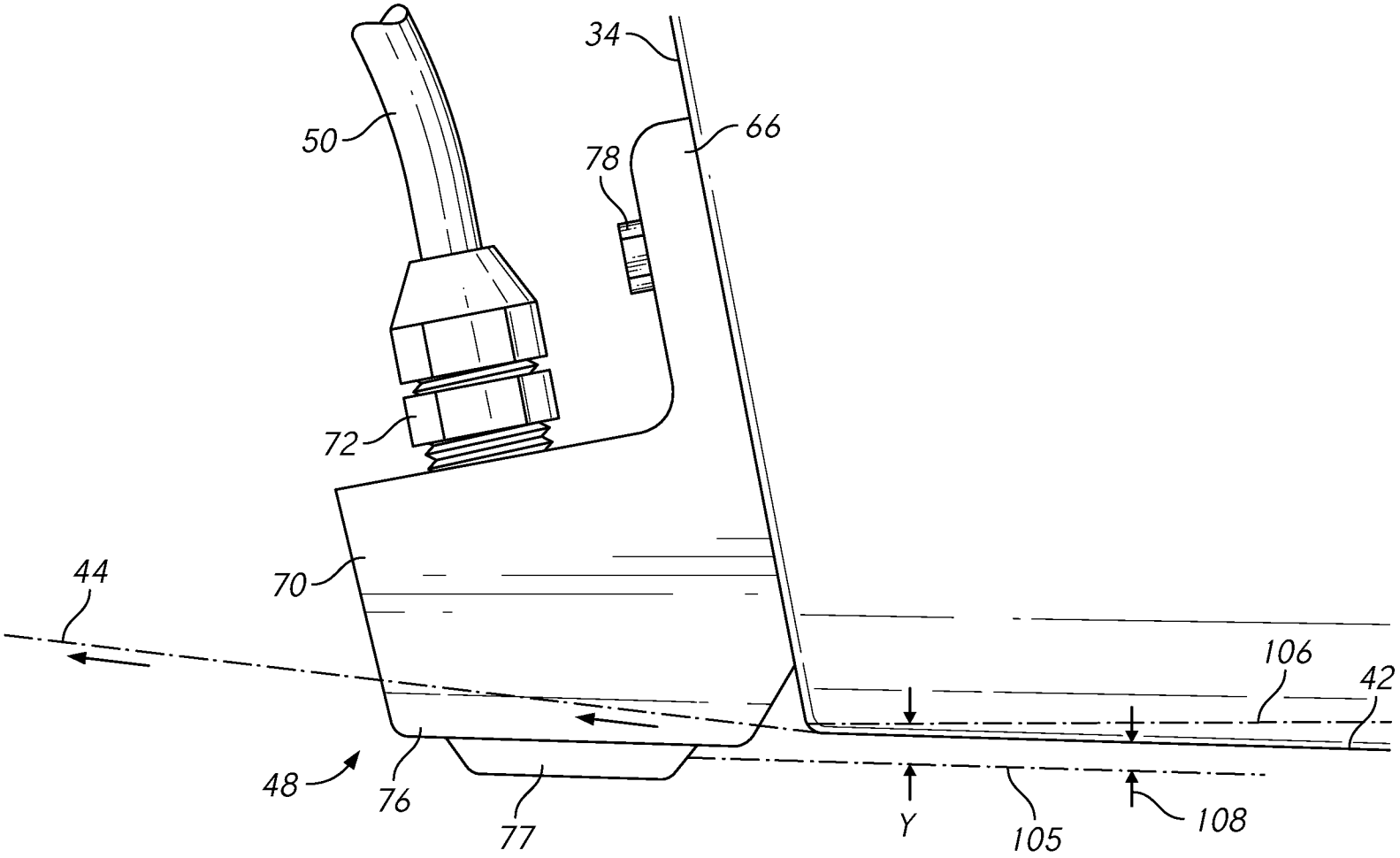
FIG. 12 is a side elevation view, showing the pickup assembly.

FIG. 12 provides a detailed side elevation view of the pickup assembly 48 installed on a boat transom 34. One or more bolts 78 is passed through mounting flange 66 and into the transom. The pickup assembly will generally be mounted on the transom—proximate the intersection between the transom and the keel. In this disclosure the term "keel" refers to the bottom of the hull proximate the portion of the transom where the pickup assembly is mounted.

Water surface 44—as it emerges from beneath the keel—will not lie perfectly on a horizontal reference 106 (a horizontal line passing through the intersection of the transom and the keel). The reader will observe how water surface 44 inclines upward as it moves aft. The water surface orientation coincides with the direction of flow of the water in the vicinity of pickup assembly 48. The water flow will be generally aligned with the orientation of the keel as it nears the transom.

Intake plane 105 runs through the center of the water intake openings in pickup assembly. In the example of FIGS. 9-12, intake plane 105 runs through the middle of the through slots 84 in the intake screens 77,79. The distance Y is the vertical distance from the intersection of transom 34 and keel 42 to intake plane 105 (with a downward displacement of intake plane 105 being denoted as positive). The distance Y is preferably in the range of −0.5 cm to +4.0 cm and even more preferably in the range of 0.0 cm to +2.0 cm. This range tends to fully immerse the intake openings without creating undue drag (A lower mounting creates more drag as the body is thrust further and further into the rapidly moving stream of water).

Intake angle 108 is also significant to the operation of the invention. Intake angle 108 is a measurement of the inclination of intake plane 105 with respect to the path of the incoming water. Since the path of the incoming water is parallel to keel 42 in the vicinity of the pickup the intake angle 108 is a measure of the inclination of intake plane 105 with respect to keel 42. A positive value is anti-clockwise. This angle is preferably in the range of −2.0 to +15.0 degrees and even more preferably in the range of 0.0 to +10.0 degrees. The provision of the positive angle affects the tendency of the moving water to "ram" itself through the openings and into the interior of body 70. However, the water engine-driven water pump creates considerable suction and the ramming action is not necessary to the operation of the invention.

Many other embodiments and variations will occur to those skilled in the art. As one example, it is possible to make a cover plate for the conventional outboard motor inlets so that the feed hoses deliver water directly through the conventional inlets rather than through one or more auxiliary cooling water inlets. As a second example, it is possible to incorporate the pickup assembly into the hull of the boat itself—rather than providing a separate bolt-on unit.

The preceding description contains significant detail regarding the novel aspects of the present invention. It should not be construed, however, as limiting the scope of the invention but rather as providing illustrations of the preferred embodiments of the invention. Many other embodiments will be made apparent to those skilled in the art. Thus, the scope of the invention should be fixed by the following claims, rather than by the examples given.

Having described my invention, I claim:

1. A system for providing cooling water to an outboard motor mounted on a transom of a boat, said boat having a hull with a keel, comprising:
- a pickup assembly attached to said transom proximate said keel, including,
  - a lower portion with an intake region,
  - an interior cavity,
  - a plurality of openings leading from said intake region to said interior cavity,
  - an outlet fitting;
- a starboard auxiliary cooling water fitting connected to a starboard inlet on said outboard motor;
- a port auxiliary cooling water fitting connected to a port inlet on said outboard motor;
- an uptake hose configured to carry water from said outlet fitting;
- a starboard feed hose connecting said uptake hose to said starboard auxiliary cooling water fitting; and
- a port feed hose connecting said uptake hose to said port auxiliary cooling water fitting.

2. The system for providing cooling water as recited in claim 1 wherein:
- said intake region includes an intake screen;
- said intake screen includes said plurality of openings and a plurality of ribs between said openings.

3. The system for providing cooling water as recited in claim 2, wherein said intake screen is replaceable.

4. The system as recited in claim 3, further comprising a cover plate configured to mount said intake screen.

5. The system as recited in claim 1, further comprising a manifold carrying water between said uptake hose and said starboard and port feed hoses.

6. The system as recited in claim 5, wherein said manifold is a transverse manifold running across a front of said outboard motor.

7. The system as recited in claim 1 wherein said intake region lies between 0 cm and 2 cm below said keel.

8. A system for providing cooling water to an outboard motor mounted on a transom of a boat, said boat having a hull with a keel, comprising:
- a pickup assembly attached proximate an intersection between said transom and said keel, including,
  - an interior cavity,
  - an intake region,
  - a plurality of openings leading from said intake region to said interior cavity, said openings being configured to admit water passing beneath said keel and past said transom into said interior cavity,
  - an outlet;
- a starboard auxiliary cooling water fitting connected to a starboard inlet on said outboard motor;
- a port auxiliary cooling water fitting connected to a port inlet on said outboard motor;
- an uptake hose configured to carry water from said outlet fitting;
- a starboard feed hose connecting said uptake hose to said starboard auxiliary cooling water fitting; and
- a port feed hose connecting said uptake hose to said port auxiliary cooling water fitting.

9. The system for providing cooling water as recited in claim 8 wherein:
- said intake region includes an intake screen;
- said intake screen includes said plurality of openings and a plurality of ribs between said openings.

10. The system for providing cooling water as recited in claim 9, wherein said intake screen is replaceable.

11. The system as recited in claim 10, further comprising a cover plate configured to mount said intake screen.

12. The system as recited in claim 8, further comprising a manifold carrying water between said uptake hose and said starboard and port feed hoses.

13. The system as recited in claim 12, wherein said manifold is a transverse manifold running across a front of said outboard motor.

14. The system as recited in claim 8 wherein said intake region lies between 0 cm and 2 cm below said keel.

15. A system for providing cooling water to an outboard motor mounted on a transom of a boat, said boat having a hull with a keel, comprising:
- a pickup assembly attached to said hull proximate an intersection between said transom and said keel, including,
  - an intake region,
  - an outlet,
  - a plurality of openings leading from said intake region to said outlet, said openings being configured to admit water passing beneath said keel and past said transom;
- a starboard auxiliary cooling water fitting connected to a starboard inlet on said outboard motor;
- a port auxiliary cooling water fitting connected to a port inlet on said outboard motor;
- an uptake hose configured to carry water from said outlet fitting;
- a starboard feed hose connecting said uptake hose to said starboard auxiliary cooling water fitting; and a port feed hose connecting said uptake hose to said port auxiliary cooling water fitting.

16. The system for providing cooling water as recited in claim 15 wherein:

said intake region includes an intake screen;

said intake screen includes said plurality of openings and a plurality of ribs between said openings.

17. The system for providing cooling water as recited in claim 15, wherein said intake screen is replaceable.

18. The system as recited in claim 16, further comprising a cover plate configured to mount said intake screen.

19. The system as recited in claim 15, further comprising a manifold carrying water between said uptake hose and said starboard and port feed hoses.

20. The system as recited in claim 19, wherein said manifold is a transverse manifold running across a front of said outboard motor.

* * * * *